US009188926B2

(12) United States Patent
Noda

(10) Patent No.: US 9,188,926 B2
(45) Date of Patent: Nov. 17, 2015

(54) IMAGE FORMING APPARATUS, IMAGE FORMING SYSTEM, AND IMAGE FORMING METHOD

(71) Applicant: Konica Minolta, Inc., Tokyo (JP)

(72) Inventor: Yoriko Noda, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/154,621

(22) Filed: Jan. 14, 2014

(65) Prior Publication Data

US 2014/0199084 A1 Jul. 17, 2014

(30) Foreign Application Priority Data

Jan. 17, 2013 (JP) ..... 2013-006706

(51) Int. Cl.
*G03G 15/00* (2006.01)

(52) U.S. Cl.
CPC ..... *G03G 15/5091* (2013.01); *G03G 15/502* (2013.01); *G03G 15/5075* (2013.01)

(58) Field of Classification Search
CPC ..... G03G 15/5016; G03G 15/502; G03G 15/5075; G03G 15/5091
USPC ..... 399/8, 81
See application file for complete search history.

(56) References Cited

U.S. PATENT DOCUMENTS

2006/0077451 A1* 4/2006 Nguyen et al. ..... 358/1.15

FOREIGN PATENT DOCUMENTS

| | | | |
|---|---|---|---|
| JP | 06-326797 | | 11/1994 |
| JP | 10319789 | A * | 12/1998 |
| JP | 2003-152916 | A1 | 5/2003 |
| JP | 2006-197436 | A1 | 7/2006 |
| JP | 2006-205671 | A1 | 8/2006 |
| JP | 2006-340259 | | 12/2006 |
| JP | 2009-255313 | A1 | 11/2009 |
| JP | 2011-8211 | A1 | 1/2011 |
| JP | 2011-73858 | A1 | 4/2011 |

OTHER PUBLICATIONS

Terasawa (JP 10-319789 A), Dec. 1998, JPO Computer Translation.*
Japanese Office Action dated Feb. 4, 2015, in counterpart Japanese Application No. 2013-006706 and its English.

* cited by examiner

*Primary Examiner* — Erika J Villaluna
(74) *Attorney, Agent, or Firm* — Lucas & Mercanti, LLP

(57) ABSTRACT

Provided is an image forming system wherein an image forming apparatus and another apparatus respectively including operation/display units are connected with each other via a network, and a remote operation of the image forming apparatus is enabled via the operation/display unit of the other apparatus, including a control unit for managing a state of the image forming apparatus, wherein when an alarm event occurs in the image forming apparatus during the remote operation, the control unit changes a display content of the operation/display unit of the image forming apparatus on which the alarm event has occurred to a first display form, and changes a display content of the operation/display unit of the other apparatus to a second display form which is different from the first display form.

17 Claims, 10 Drawing Sheets

IMAGE FORMING APPARATUS, IMAGE FORMING SYSTEM, AND IMAGE FORMING METHOD

BACKGROUND OF THE INVENTION

1. Field of the Invention

The present invention relates to an image forming apparatus for forming an image on a paper, an image forming system including the image forming apparatus, and an image forming method.

2. Description of the Related Art

Printing is carried out by forming a toner image on a photoreceptor provided in an image forming unit based on image data acquired by reading from a document reading apparatus, for example, transferring the toner image to a paper fed from a tray, and fixing the toner image in an image forming apparatus such as a copier, a printer, and a multi-function machine. Moreover, an image forming apparatus including a finisher, thereby enabling post processing such as stapling and punching is proposed.

The image forming and the post-processing are carried out based on set contents such as job setting on the image forming apparatus. The job setting can be carried out by an operator via an operation/display unit.

Moreover, image forming systems for enabling a remote operation of an image forming apparatus by using an external apparatus connected via a communication network for the sake of utility for a user are proposed (refer to Japanese Patent No. 3042655 and Japanese Patent Application Laid-open No. 2006-340259).

According to Japanese Patent No. 3042655, a display same as that on a display unit of the image forming apparatus, and a display imitating operation keys are displayed on a display unit of a workstation for the remote operation.

According to Japanese Patent Application Laid-open No. 2006-340259, in an image forming system where multiple image forming apparatuses can be remotely operated via a network, a display of which image forming apparatus main body is being carried out can be displayed in an easy-to-understand manner.

By the way, for example, after papers are sufficiently supplied, and the job setting is carried out, the user may not always stay in front of the machine in the image forming apparatus. Thus, for example, if there is an alarm for a jam or a toner supply, a large-scale alarm display such as an alarm using an entire screen of a display unit, or a blinking display is carried out so that a user tends to recognize the alarm even if the user is remote from the image forming apparatus.

Moreover, the image forming system enabling the remote operation of the image forming apparatus via the communication network so that the user can carry out a monitoring without staying in front of the apparatus also preferably carries out an alarm display upon a jam.

For example, the jam or the like requires an actual operation in front of an image forming apparatus main body, a reset of the alarm (jam reset) is required before the actual print operation, and thus the large scale alarm is necessary. However, the alarm display such as that for the jam which can be reset only in front of the image forming apparatus main body is not often necessary (however, the generation of jam needs to be recognized), and the large-scale alarm which prevents an operation such as remote generation of a job poses a problem in the image forming system for the remote operation via the network.

SUMMARY OF THE INVENTION

The present invention has been made in view of the above-mentioned problem, and therefore has objects to provide an image forming apparatus, an image forming system, and an image forming method for changing a display content to a different display form on operation/display units of the image forming apparatus and an external apparatus when an alarm event occurs.

To achieve at least one of the above-mentioned objects, an image forming system reflecting one aspect of the present invention wherein an image forming apparatus and another apparatus respectively including operation/display units are connected with each other via a network, and a remote operation, of the image forming apparatus is enabled via the operation/display unit of the other apparatus, includes a control unit for managing a state of the image forming apparatus, wherein when an alarm event occurs in the image forming apparatus during the remote operation, the control unit changes a display content of the operation/display unit of the image forming apparatus on which the alarm event has occurred to a first display form, and changes a display content of the operation/display unit of the other apparatus to a second display form which is different from the first display form.

In the image forming system, the first display form is preferably constructed by a display configuration relatively high in attracting attention, and the second display form is preferably constructed by a display configuration relatively low in attracting attention.

In the image forming system, the first display form preferably includes an entire alarm display or a blinking display, and the second display form preferably includes a partial alarm display.

In the image forming system, when the alarm event occurs, if the image forming apparatus in which the alarm event has occurred is in an operation condition, the control unit preferably changes the display content of the operation/display unit of the image forming apparatus to the second display form.

In the image forming system, if the alarm event is determined to correspond to an emergency alarm event, the control unit preferably changes the display content of the operation/display unit of the other apparatus to the first display form.

In the image forming system, the control unit preferably enables a remote operation by the other apparatus based on an operator authentication, and when the alarm event occurs, preferably changes the display content of the operation/display unit of the other apparatus according to the operator authentication.

In the image forming system, the other apparatus is preferably an external apparatus or another image forming apparatus.

To achieve at least one of the above-mentioned objects, an image forming apparatus reflecting one aspect of the present invention, connected via a network to another apparatus, and remotely operable via an operation/display unit of the other apparatus, includes: an operation/display unit capable of carrying out operation and display of the own apparatus; and a control unit for managing a state of the image forming apparatus, wherein when an alarm event occurs during the remote operation, the control unit changes a display content of the operation/display unit of the own apparatus to a first display form, and changes a display content of the operation/display unit of the other apparatus to a second display form which is different from the first display form.

In the image forming apparatus, the first display form is preferably constructed by a display configuration relatively high in attracting attention, and the second display form is preferably constructed by a display configuration relatively low in attracting attention.

In the image forming apparatus, the first display form preferably includes an entire alarm display or a blinking display, and the second display form preferably includes a partial alarm display.

In the image forming apparatus, wherein when the alarm event occurs, if the operation/display unit of the own apparatus is in an operation condition, the control unit preferably changes the display content of the operation/display unit of the own apparatus to the second display form.

In the image forming apparatus, wherein if the alarm event is determined to correspond to an emergency alarm event, the control unit preferably changes the display content of the operation/display unit of the other apparatus to the first display form.

In the image forming apparatus, the control unit enables a remote operation by the other apparatus based on an operator authentication, and when the alarm event occurs, preferably changes the display content of the operation/display unit of the other apparatus according to the operator authentication.

In the image forming apparatus, the operation/display unit of the own apparatus is preferably provided above an apparatus top surface, and a display screen is preferably provided to face to a front side.

To achieve at least one of the above-mentioned objects, an image forming method reflecting one aspect of the present invention for forming an image via an image forming apparatus and another apparatus respectively including operation/display units, and connected with each other via a network, the other apparatus capable of remotely operating the image forming apparatus, includes: managing a state of the image forming apparatus; determining whether an alarm event has occurred on the image forming apparatus based on the state during the remote operation; and changing a display content of the operation/display unit of the image forming apparatus on which the alarm event has occurred to a first display form, and changing a display content of the operation/display unit of the other apparatus to a second display form which is different from the first display form when it is determined that the alarm event occurs.

DETAILED DESCRIPTION OF THE PREFERRED EMBODIMENTS

Figure 1:
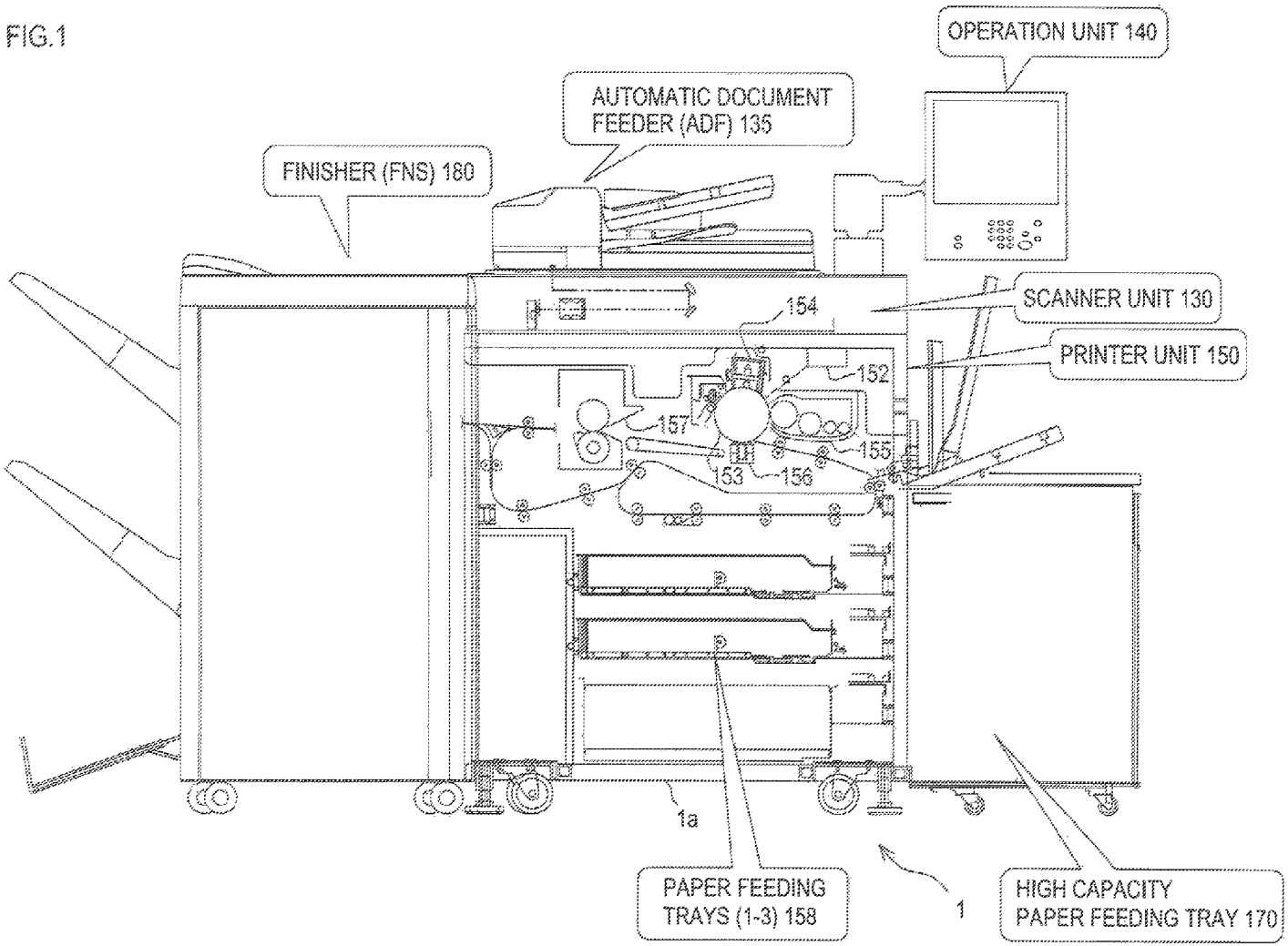
FIG. 1 is a diagram showing a mechanical configuration of an image forming apparatus according to an embodiment of the present invention.

A description will now be given of an embodiment according to the present invention referring to accompanying drawings.

An image forming apparatus 1 is configured by connecting a high capacity paper feeding tray 170 to a prior stage side of an image forming apparatus main body 1*a*, and connecting a finisher (FNS) 180 to a posterior stage side of the image forming apparatus main body 1*a*. A paper can be transported between the respective apparatuses, and the respective apparatuses can communicate with each other in the image forming apparatus 1.

The image forming apparatus main body 1*a* is provided with, on a top portion side, a scanner unit 130 including a CCD 131 and a flow-in type automatic document feeder (ADF) 135, thereby enabling reading of an image of a document through a platen glass or a slit glass for reading an ADF document.

The scanner unit 130, the flow-in type automatic document feeder (ADF) 135, the platen glass, the slit glass for reading ADF document, and the like described above constitute an image reading unit.

Moreover, an operation unit 140 including a touch panel is provided at a location on an upper side of the image forming apparatus main body 1*a* where the platen glass does not exist above a top surface of the other portions of the apparatus so that a display screen faces the front side, thereby enabling operations by an operator and display of information. The operation unit 140 corresponds to an operation/display unit according to the present invention. The operation/display unit carries out various displays as well as receives operation inputs. It should be noted that an operation unit and a display unit may be constructed independently of each other according to the present invention, and the operation and display may be carried out by the operation unit and the display unit independent of each other.

Multiple paper feeding trays (1-3) 158 (three in the drawing) are arranged on a bottom side of the image forming apparatus 1*a*, and a high capacity paper feeding tray 170 including a paper feeding tray is further arranged adjacent to the image forming apparatus main body 1*a*.

A transport path and paper feeding rollers for transporting a paper fed from any of the paper feeding trays are provided in the image forming apparatus main body 1*a*, and an image forming unit constructed by an electrifier 154, an LD 152, a photoreceptor 153, a developing device 155, a transfer unit 156, a fixing device 157 is provided in the course of the transport path in the image forming apparatus main body 1*a*. Moreover, a transport path (not shown) for transporting a fed paper, and introducing the paper into the image forming apparatus main body 1*a* is provided in the high capacity paper feeding tray 170. Further, the finisher (FNS) 180 includes a paper discharge path for transporting a paper on which an image is printed, and discharging the paper with/without finishing.

The image forming unit, the paper feeding trays (1-3) 158, the high-capacity paper feeding tray 170, the transport path, the paper feeding rollers, and the like construct a printer unit 150 according to the present invention.

The electrifier 154, the developing device 155, and the transfer unit 156 are arranged around the photoreceptor 153 in the image forming unit. The electrifier 154 uniformly electrifies a surface of the photoreceptor 153 before an image is written. The LD 152 irradiates a semiconductor laser on the photoreceptor 153 having the uniformly electrified surface, thereby forming a latent electrostatic image on the photoreceptor 153. The developing device 155 develops the electrostatic latent image formed by the LD 152 on the photoreceptor 153 by a toner material. The development processing forms a toner image on the photoreceptor 153. The transfer unit 156 transfers the toner image on the photoreceptor 153 onto a paper transported from the paper feeding trays (1-3) 158 and the high capacity paper feeding tray 170. The paper on which the toner image is transferred is separated from the photoreceptor 153, and is transported to the fixing device 157. The toner material remaining on the photoreceptor 153 is removed by a cleaning unit.

The fixing device 157 fixes the toner image transferred to a front surface side of the paper by heating the transported paper. The paper to which the fixing processing is applied is directly transported to the finisher (FNS) 180 provided on a side of the image forming apparatus main body 1*a* for the simplex printing.

On the finisher (FNS) 180, finishing such as punching, stapling, and center folding is carried out, and the paper is discharged. On the other hand, for duplex printing, the paper after fixing is switched back, and a predetermined image is transferred by the image forming unit on the rear surface side of the paper. Then, the paper on both sides of which the images are formed is transported to the finisher (FNS) 180.

Though the image forming apparatus 1 is constructed by the image forming apparatus main body 1*a*, the high capacity paper feeding tray 170, and the finisher (FNS) 180, according to the present invention, apparatuses constructing the image forming apparatus are not specifically limited in the number and the type except for the image forming apparatus main body, the image forming apparatus 1 may include multiple finishers, and various external apparatuses such as a relay apparatus, and a stack apparatus may be additionally connected. Moreover, the image forming apparatus may be constructed only by the image forming apparatus main body.

Figure 2:
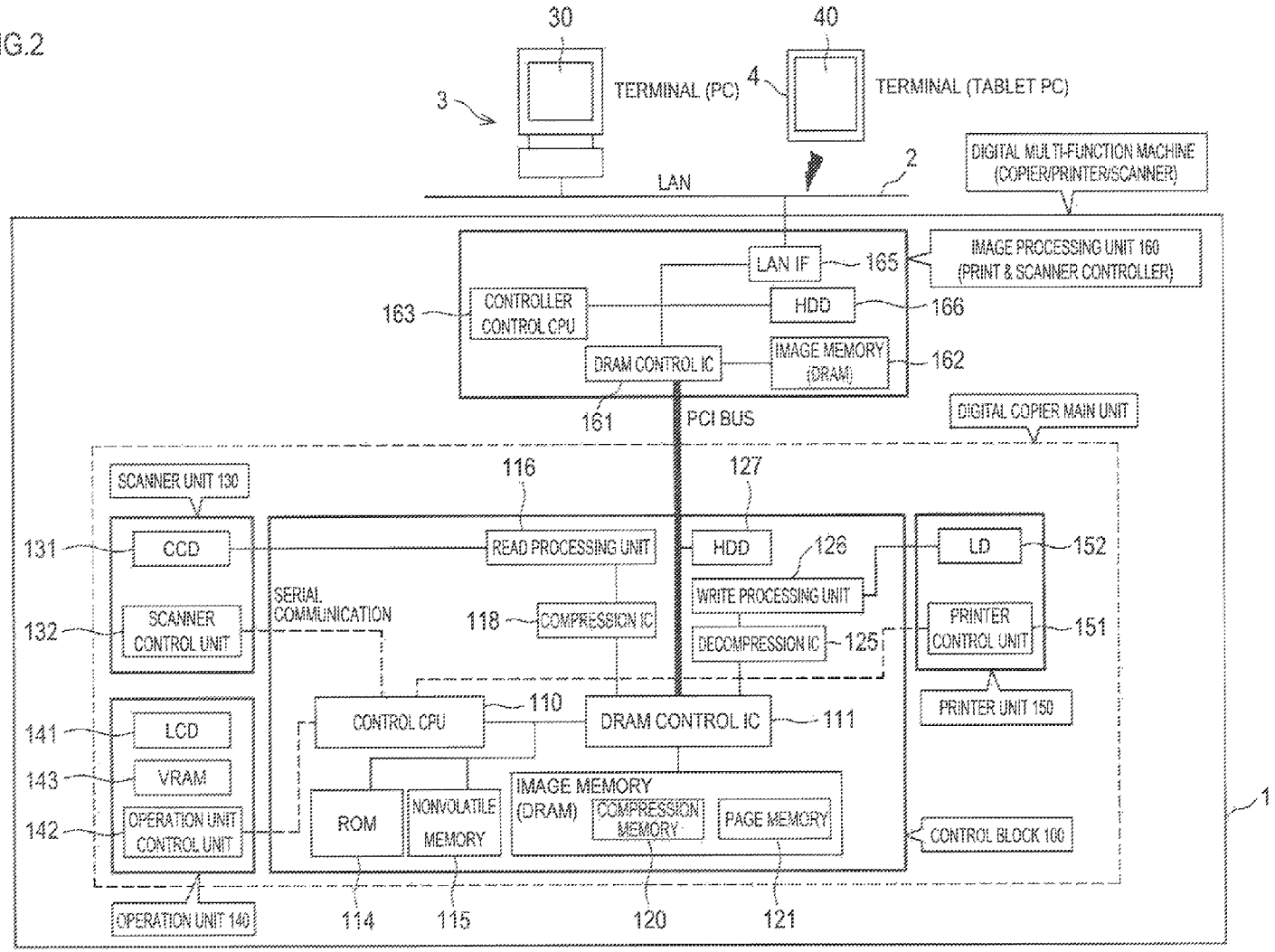
FIG. 2 is a diagram showing control blocks of an image forming system according to the embodiment of the present invention.

FIG. 2 is a diagram showing control blocks of an image forming system according to the embodiment.

The image forming system includes the image forming apparatus 1, a terminal (PC) 3, and a terminal (tablet PC) 4, and they are connected with each other for communication via a LAN 2, which is a network. The network may be wired or wireless, may employ a telephone line or a data line, and a form of the network is not specifically restricted. It should be noted that the terminal (tablet PC) 4 is connected to the LAN 2 via a wireless LAN, which is not shown. The terminal (PC) 3 and the terminal (tablet PC) 4 correspond to other apparatuses according to the present invention for remotely operating the image forming apparatus 1.

There is such a technology that an apparatus on which a www (world wide web) server and a browsing software program are operating displays operation screens for the image forming apparatus as web pages for the remote operation of the image forming apparatus. Specifically, the browser on the other apparatus displays the web pages provided by the image forming apparatus using the web server as the operation screens, thereby enabling the operation of the image forming apparatus from the other apparatus. In addition, there is a technology to use a remote application program such as the virtual network computing (VNC) software (trademark) to display the operation screens for the image forming apparatus on an apparatus for the remote operation. However, the method of the remote operation is not limited to a specific method according to the present invention. The other apparatus for the remote operation may be the external apparatus as well as another image forming apparatus.

The type and the number of the apparatuses connected to the image forming apparatus 1 are not specifically limited. Multiple image forming apparatuses may be connected to the image forming system via the LAN 2, or the terminal (PC) 3 or the terminal (tablet PC) 4 may not be connected. The terminal (PC) 3 and the terminal (tablet PC) 4 respectively include operation units 30 and 40 for displaying screens and receiving operations, and the operation units 30 and 40 correspond to operation/display units of the other apparatuses according to the present invention. The operation/display unit carries out various displays as well as receives operation inputs. The operation/display unit may carry out the operation and the display respectively on independent operation unit and display unit.

The terminal (PC) 3 and the terminal (tablet PC) 4 can display the screens and can carry out the operations relating the image forming apparatus 1 on the operation units 30 and 40 via VNC clients.

The image forming apparatus 1 includes a control block 100, a scanner unit 130, an operation unit 140, and a printer unit 150 as major components. The operation unit 140 corresponds to an operation/display unit according to the present invention.

Moreover, the control block 100 is provided with a control CPU 110, and a DRAM control IC 111 is connected to the control CPU 110. A ROM 114 and a non-volatile memory 115 are connected to the control CPU 110. The ROM 114 stores programs and the like for operating the control CPU 110. The non-volatile memory 115 is constructed by a flash memory or the like, and stores initial print setting information on the image forming apparatus 1, machine setting information such as process control parameters, initial data for output setting, screen information to be displayed on the operation unit, and the like.

Moreover, the control CPU 110 can read non-volatile data in the non-volatile memory 115, and can write desired data in the non-volatile memory 115.

The control CPU 110 controls operations of the respective parts of the image forming apparatus 1 according to the machine setting information, the print setting information, and the output setting. Moreover, contents of alarm events and contents of emergency alarm events can be set to the non-volatile memory 115, and the control CPU 110 determines generation of the alarm event and generation of the emergency alarm event based on the stored data of the non-volatile memory 115.

A jam, an exhaustion of papers and failures which prevent the image forming apparatus from normally operating, as well as arrival of a supply timing of consumables, and arrival of a replacement timing of replaceable components can be mentioned as the alarm events.

The control CPU 110 constructs a control unit according to the present invention along with the ROM 114 and the non-volatile memory 115, controls the image forming system, and recognizes an entire state of the image forming system.

The scanner unit 130 is provided with a CCD 131 for optical reading, and a scanner control unit 132 for controlling the entire scanner unit 130. The scanner control unit 132 is connected to the control CPU 110, and is controlled by the control CPU 110. It should be noted that the scanner control unit 132 can be constructed by a CPU, programs for operating the CPU, and the like. A read processing unit 116 applies data processing to read image information read by the CCD 131. The read processing unit 116 is connected to the DRAM control IC 111, and the image data to which the data processing is applied by the read processing unit 116 is transmitted to the DRAM control IC 111.

The operation unit 140 includes the LCD 141 of touch panel type, an operation unit control unit 142, and a VRAM 143, the LCD 141 and the VRAM 143 are connected to the operation unit control unit 142, and the operation unit control unit 142 and the control CPU 110 are connected with each other for serial communication. As a result of this configuration, the operation unit 140 is controlled by the control CPU 110, and a screen image drawn in the VRAM 143 is displayed on the LCD 141, and input information into the operation unit 140 is transmitted to the control CPU 110. It should be noted that the operation unit control unit 142 can be constructed by a CPU, programs for operating the CPU, and the like.

The control CPU 110 draws an operation screen to be displayed on the terminal (PC) 3 and the terminal (tablet PC) 4 for the remote operation on the VRAM 143, transmits the screen image to the terminal (PC) 3 and the terminal (tablet PC) 4, and displays the operation screen on the operation screens 30 and 40 for operation.

Moreover, a compression IC 118 for compressing image data and a decompression IC 125 for decompressing image data are connected to the DRAM control IC 111. An image memory (DRAM) including a compression memory 120 and a page memory 121 are further connected to the DRAM control IC 111, and an HDD 127 is further connected via a PCI bus to the DRAM control IC 111. The DRAM control IC 111 controls compression processing for image data by the compression IC 118 and decompression processing for compressed image data by the decompression IC 125 according to an instruction from the control CPU 110, and carries out input/output control for image data to/from the image memory (DRAM) and the HDD 127.

A write processing unit 126 is connected to the LD 152 of the printer unit 150, and generates write data used for an operation of the LD 152 based on image data.

The printer unit 150 is constructed by the image forming unit, the paper feeding trays (1-3) 158, a transport path, and the like.

Moreover, the printer unit 150 is provided with a printer control unit 151 for controlling the entire printer unit 150 (such as paper feeding, image forming, paper discharge, and the finishing), and the printer control unit 151 is connected to the control CPU 110 for serial communication. The printer control unit 151 operates according to a control instruction from the control CPU 110, and controls the printer unit 150 to carry out the paper transport, the image formation, and the like.

Moreover, the DRAM control IC 161 of an image processing unit (print and scanner controller) 160 is connected to the PCI bus to which the DRAM control IC 111 is connected. The image processing unit (print and scanner controller) 160 receives image data and the like on the image forming apparatus main body 1*a* from the terminal (PC) 3, the terminal (tablet PC) 4, and the like connected to the LAN 2, and transmits the image data acquired by the scanner unit 130 to the terminal (PC) 3, the terminal (tablet PC) 4, and the like connected to the LAN 2 when the image forming apparatus main body 1*a* is used as a network printer or a network scanner.

An image memory 162 constructed by a DRAM or the like is connected to the DRAM control IC 161 in the image processing unit (print and scanner controller) 160. Moreover, in the image processing unit (print and scanner controller) 160, a controller control CPU 163 for carrying out control for the entire image processing unit (print and scanner controller) 160, a LAN interface 165, and an HDD 166 are connected to a common bus. The LAN interface 165 is connected to the LAN 2.

A description will now be given of a basic operation of the image forming system.

First, a description will be given of a sequence for accumulating image data in the image forming apparatus main body 1*a*.

A description will be given of a case where an image is read by the scanner unit 130, thereby generating image data in the image forming apparatus main body 1*a*. The image is optically read by the CCD 131 from a document in the scanner unit 130. On this occasion, an operation of the CCD 131 is controlled by the scanner control unit 132, which receives an instruction from the control CPU 110. The document reading can be carried out while the document is automatically being fed by the automatic document feeder (ADF) 135, or the document is placed on the platen glass.

The control CPU 110 operates according to a program, and issues an instruction based on an operation (such as read instruction and a copy instruction) carried out on the operation/display unit 140 to the scanner unit 130. Data processing is applied to the image read by the CCD 131 by the read processing unit 116, and image data to which the data processing is applied is transmitted via the DRAM control IC 111 to the compression IC 118, and is compressed by means of a predetermined method. The compressed data is stored via the DRAM control IC 111 in the compression memory 120 in the image memory (DRAM). If the data is to be stored in the HDD 127, the data once stored in the compression memory 120 is transmitted via the DRAM control IC 111 to the HDD 127.

In addition thereto, the image data is input via the LAN 2 into the image forming apparatus main body 1*a*. As the image data, for example, image data generated by an application program and the like in the terminal (PC) 3, the terminal (tablet PC) 4 and the like can be mentioned. The generation method for the image data is not specifically limited.

The image data is received via the LAN 2 and the LAN interface 165 by the image processing unit (print and scanner controller) 160, and is once stored in the image memory 162 or the HDD 166. The data stored in the image memory 162 or the HDD 166 undergoes data processing depending on necessity, is transmitted via the PCI bus to the DRAM control IC 111, and is once stored in the page memory 121. The data stored in the page memory 121 is transmitted via the DRAM control IC 111 to the compression IC 118, undergoes the compression processing, and is stored via the DRAM control IC 111 in the compression memory 120. If the data is to be stored in the HDD 127, the data once stored in the compression memory 120 is transmitted via the DRAM control IC 111 to the HDD 127.

For accumulating the image data, output setting is carried out before or after the accumulation of the image data. The output setting can be carried out by an operation input by an operator while a setting screen which enables the operation input is displayed on the operation unit 140. Moreover, even if output setting items have been selected in an initial setting, and the operator does not carry out the setting input, the output setting is also carried out by the initial setting. Moreover, the setting input can be carried out by the operation unit 30 or the operation unit 40 of the terminal (PC) 3 or the terminal (tablet PC) 4 for the remote operation.

When an image output is carried out in the image forming apparatus 1, namely the image forming apparatus 1 is used as a copier or a printer, the image data stored in the compression memory 120 is sent out via the DRAM control IC 111 to the decompression IC 125, thereby decompressing the data, the decompressed data is sent out to the write processing unit 126, and writing is carried out by the LD 152 on the photoreceptor 153 electrified by the electrifier 154.

When the image data stored in the HDD 127 is used, the image data stored in the HDD 127 is once stored via the DRAM control IC 111 in the compression memory 120, the image data stored in the compression memory 120 is sent out via the DRAM control IC 111 to the decompression IC 125, thereby decompressing the data, and the decompressed data is sent out to the write processing unit 126 as described above.

The printer control unit 151, which has received an instruction of the control CPU 110, controls respective units in the printer unit 150. A latent image written on the photoreceptor 153 is developed as a toner image by the developing device 155 in the image forming unit, and the toner image is transferred by the transfer unit 156 onto a paper fed by the transport path, and is fixed by the fixing device 157. On the photoreceptor 153, after the toner image is transferred onto the paper, remaining toner is removed by the cleaning unit.

Though a description is given of the embodiment assuming the monochrome image forming, the image forming main body may be an image forming apparatus main body including photoreceptors for respective colors (such as cyan, magenta, yellow, and black).

The paper on which the image is formed is transported via the transport path to the finisher (FNS) 180, if the finishing setting has been carried out, predetermined finishing is carried out, the paper is discharged, and if the finishing setting has not been carried out, the paper is directly discharged.

Moreover, the terminal (PC) 3 and the terminal (tablet PC) 4 can remotely control the image forming apparatus 1 as described above. A description will now be given of the VNC as an example, a VNC (trademark, the same hereinafter) server is provided on the image forming apparatus 1, and VNC clients are provided on the terminal (PC) 3 and the terminal (tablet PC) 4.

The VNC client has a function of acquiring screen data from the VNC server on the image forming apparatus 1, passing the screen data to the own operation unit control unit 142, thereby displaying the screen data on the operation unit 30 or the operation unit 40, receiving an operation on the screen, and transmitting the operation to the VNC server on the image forming apparatus 1. When a notification of a remote operation is transmitted from the connected VNC client, the VNC server draws a display screen for the remote operation on the VRAM 143 by means of a graphic driver or the like, and transmits the screen data drawn in the VRAM 143 to the VNC client. Then, the VNC server receives operation information from the VNC client, and transmits the operation information to the control CPU 110. The control CPU 110 carries out control according to an operation content on the operation unit 30 or the operation unit 40. As a result, the operation units 30 of the terminal (PC) 3 and the operation unit 40 of the terminal (tablet PC) 4 can remotely control the image forming apparatus 1.

Figure 3:
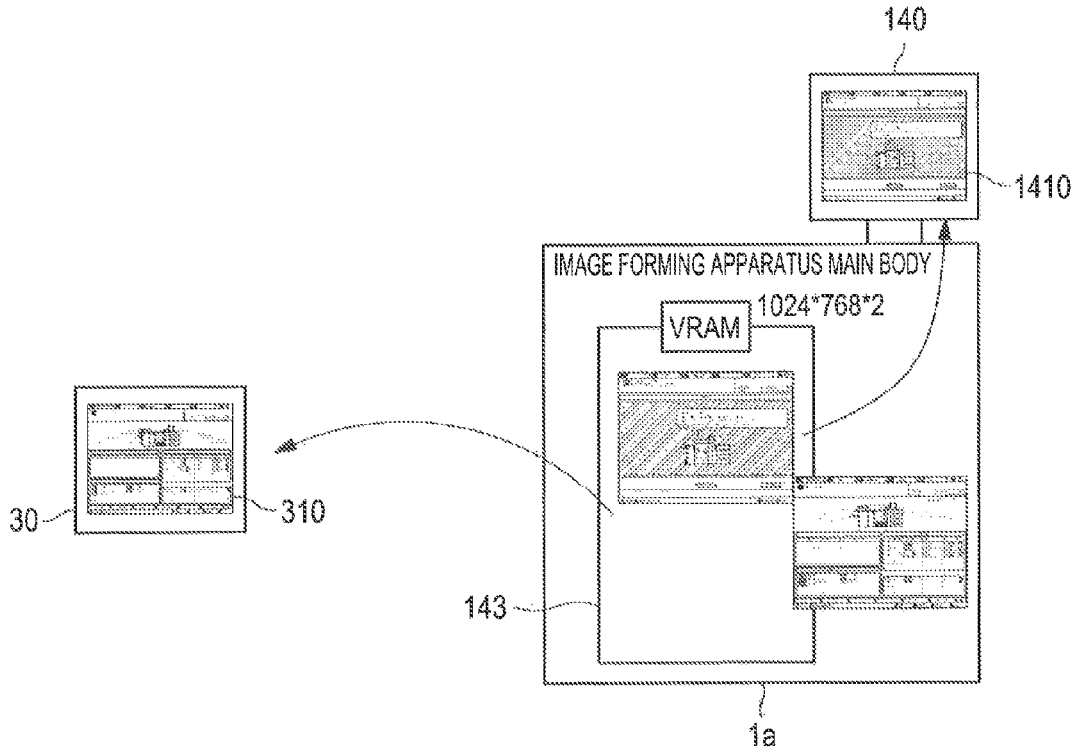
FIG. 3 is a schematic diagram showing a screen display example in a remote operation according to the embodiment of the present invention.

FIG. 3 shows such a state that the display screen drawn in the VRAM 143 is displayed for operation on a screen 1410 of the operation unit 140 and a screen 310 of the operation unit 30 of the terminal (PC) 3.

Figure 4:
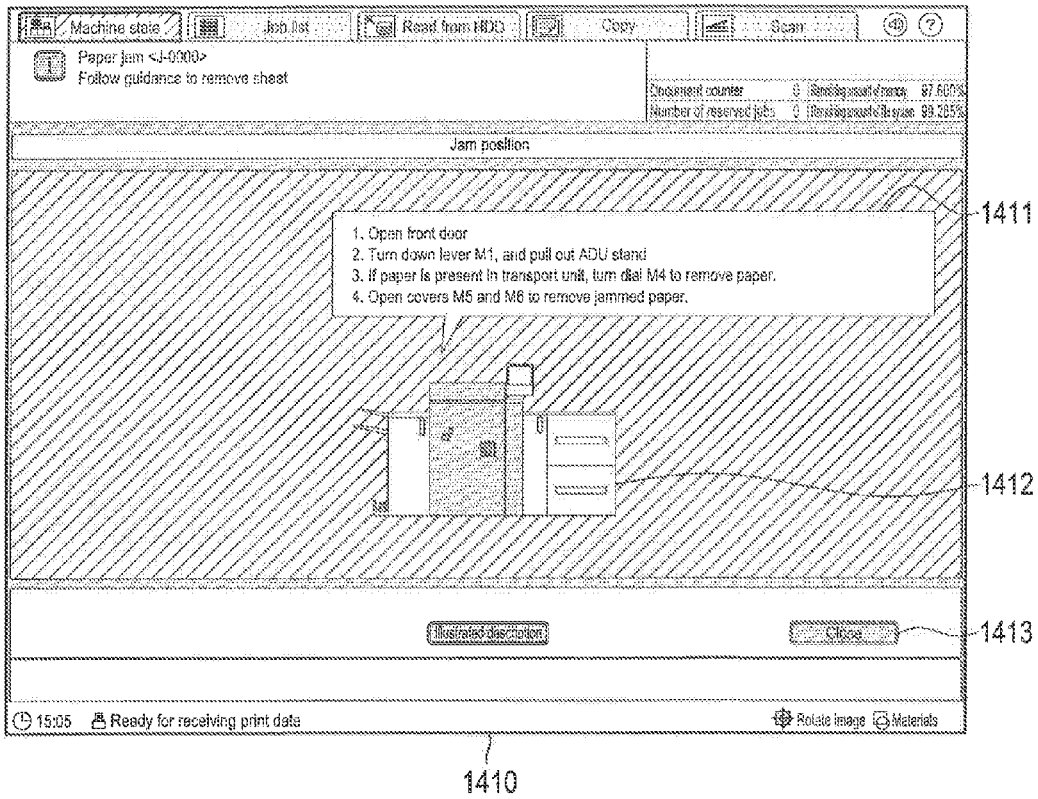
FIG. 4 is a diagram showing a screen example in a first display form according to the embodiment of the present invention.

FIG. 4 shows, in an enlarged form, the display screen 1410 displayed on the operation unit 140, and the screen 1410 is displayed when an alarm event is generated on the image forming apparatus 1 by changing a display content before the alarm event is generated, and corresponds to a first display state according to the present invention.

The screen 1410 carries out an alarm display on almost all of a display area of the operation unit 140, namely on the entire screen, and an alarm message 1411 and an alarm illustration 1412 for describing a content of the alarm event are displayed. A "Close" button 1413 is displayed for depressing, and the screen returns to the previous screen by depressing the "Close" button 1413 on the screen 1410. Moreover, blinking of a tab and entire screen display in red are carried out on the screen 1410, and a display relatively high in attracting attention is carried out.

The screen 1410 is the screen high in attracting attention of the user, and an operation relating to the operation of the image forming apparatus 1 cannot be carried out.

Figure 5:
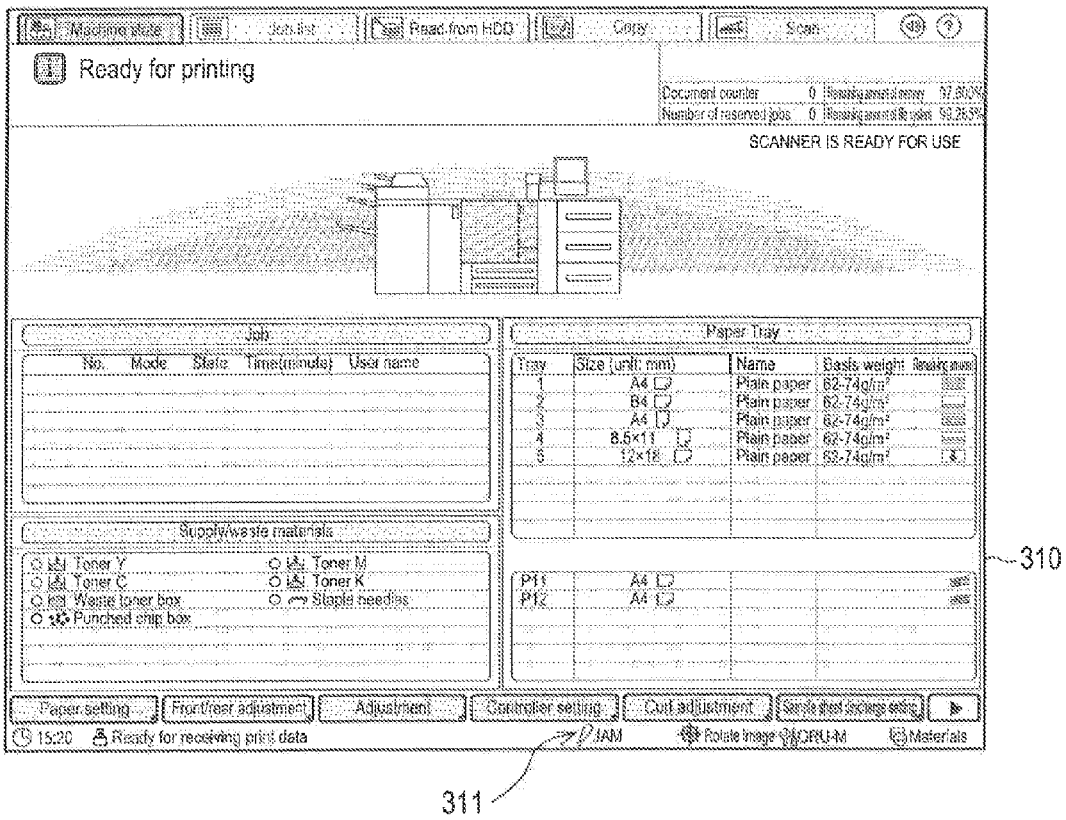
FIG. 5 is a diagram showing a screen example in a second display form according to the embodiment of the present invention.

FIG. 5 shows, in an enlarged form, the display screen 310 displayed on the terminal (PC) 3, and the screen 310 is displayed when an alarm event is generated on the image forming apparatus 1 by changing a display content before the alarm event is generated, and corresponds to a second display state according to the present invention.

The screen 310 displays almost all of an operation screen before the alarm event generation, and an icon 311 showing a jam generation is displayed as an alarm display as a part thereof. A particularly remarkable alarm is not displayed in this example, and only the JAM icon is displayed at the bottom side.

Though the screen 310 displays the icon 311 for notifying the user of the alarm event generation, the remote operation itself is available for the image forming apparatus 1, and the screen 310 is a screen relatively low in attracting attention. A display content excluding the icon 311 in the screen 310 corresponds to a display content of a screen displayed for operation on the operation unit 140 or 30 before the alarm event generation.

As described above, according to this embodiment, when an alarm event is generated on the image forming apparatus during the remote operation, the display content can be changed so that the content is different between the image forming apparatus on which the alarm event is generated and another apparatus used for the remote operation, a display emphasizing the alarming can be carried out on one apparatus, and a display securing the operability can be carried out on the other apparatus. It should be noted that multiple image forming apparatuses may be connected with each other in the image forming system. The display content may be changed during the remote operation for the image forming apparatus from another apparatus for the remote operation as well as in a state without the remote operation for the image forming apparatus.

Further, the display content may be changed to the content prioritizing the attention attraction on the image forming apparatus on which the alarm event occurs, and the display content may be changed to the display content which is low in the attention attraction for enabling the remote operation, but includes the display content including the attention on another apparatus for the remote operation according to this embodiment.

Figure 6:
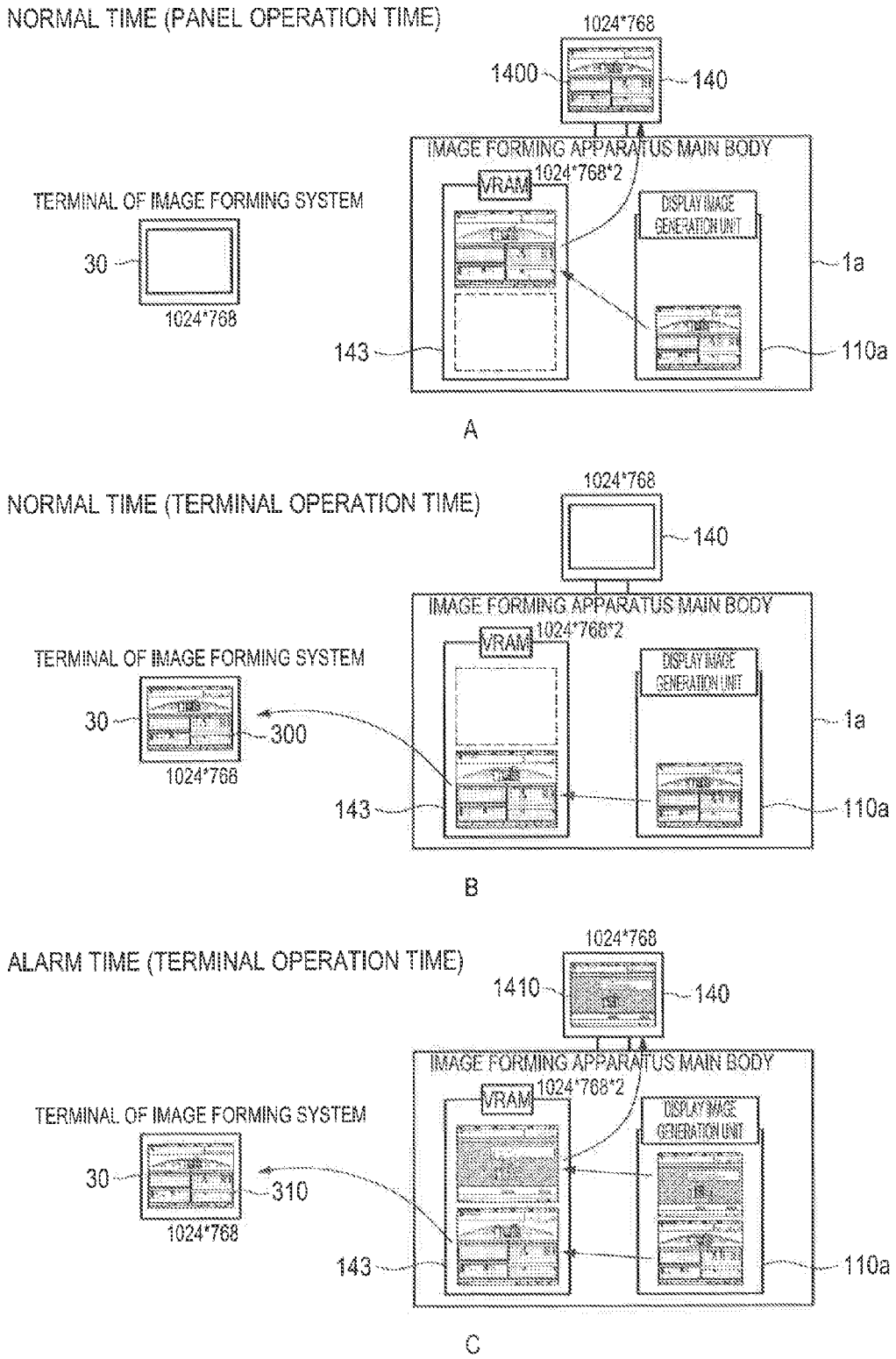
FIG. 6 is a diagram showing a screen display example of an operation unit in a normal VRAM use according to the embodiment of the present invention.
Figure 7:
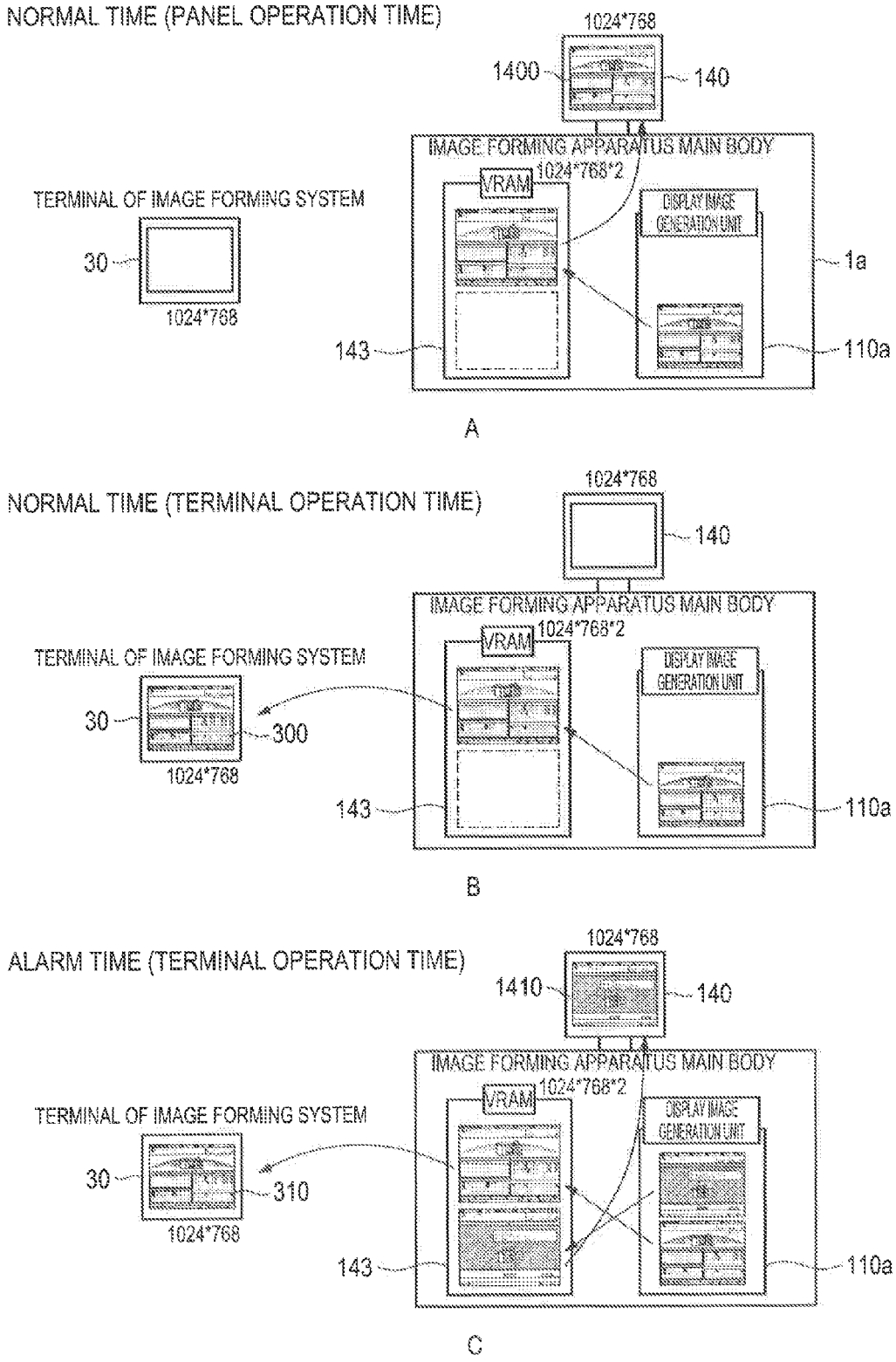
FIG. 7 is a diagram showing a screen display example of the operation unit in an extended VRAM use according to the embodiment of the present invention.

A description is now given of examples of the display screen based on an operation form referring to FIGS. 6 and 7.

In the example in FIG. 6, a first half area (corresponding to a number of pixels 1024×768) of the VRAM 143 (corresponding to a number of pixels 1024×768×2) is used for drawing a display content displayed on the operation unit 140, and a second half area (corresponding to a number of pixels 1024×768) of the VRAM 143 is used for drawing a display content displayed on the operation unit 30. It should be noted that a display image generation unit 110*a* in the following description is constructed by a part of functions of the control CPU 110.

Data for the display image displayed on the operation unit 140 is generated by the display image generation unit 110*a*, the display screen is drawn in the first half area of the VRAM 143, and an image 1400 for operation is displayed on the screen operation unit 140 based on the display screen data as shown in FIG. 6(A) during a normal state (panel operation state) where the operation unit 140 (panel) of the image forming apparatus 1 is used.

On the other hand, data for a display image displayed on the operation unit 30 is generated by the display image generation unit 110*a*, a display screen is drawn in the second half area of the VRAM 143, and an image 300 is displayed for operation on the operation unit 30 based on the display screen data as shown in FIG. 6(B) during the remote operation by the terminal (PC) 3 (during the terminal operation).

Then, if an alarm event such as a jam occurs, data for a display image displayed on the operation unit 140 and data for a display image displayed on the operation unit 30 are generated by the display image generation unit 110*a*, a display screen for the operation unit 140 is drawn in the first half area of the VRAM 143, and a display screen for operation unit 30 is drawn in the second half area of the VRAM 143 as illustrated in FIG. 6(C). The display content of the operation unit 140 is changed to the content (image 1410 corresponding to the first display form) drawn in the first half area of the VRAM 143, and the display content of the operation unit 30 is changed to the content (image 310 corresponding to the second display form) drawn in the second half area of the VRAM 143.

The image 1410 displays the alarm as the entire screen display as described above, and the image 310 displays the alarm as the icon, and enables operation for the image forming apparatus 1 as described above.

In the example in FIG. 7, the first half area (corresponding to the number of pixels 1024×768) of the VRAM 143 (corresponding to the number of pixels 1024×768×2) is used for drawing a display content for the operation, and the second half area (corresponding to the number of pixels 1024×768) of the VRAM 143 is used for drawing a display content high in attracting attention when an alarm event occurs.

Data for the display image displayed on the operation unit 140 is generated by the display image generation unit 110*a*, and the display screen is drawn in the first half area of the VRAM 143, and is displayed as the image 1400 for operation on the screen operation unit 140 as shown in FIG. 7(A) during a normal state (panel operation state) where the operation unit 140 (panel) of the image forming apparatus 1 is used.

On the other hand, data for a display image displayed on the operation unit 30 is generated by the display image generation unit 110*a*, a display screen is drawn in the first half area of the VRAM 143, and is displayed as the image 300 for operation on the operation unit 30 as shown in FIG. 7(B) during the remote operation by the terminal (PC) 3 (during the terminal operation).

Then, if an alarm event such as a jam occurs, data for a display image displayed on the operation unit 140 and data for a display image displayed on the operation unit 30 are generated by the display image generation unit 110*a*, a display screen for the operation unit 30 is drawn in the first half area of the VRAM 143, and a display screen for operation unit 140 is drawn in the second half area of the VRAM 143 as illustrated in FIG. 7(C). Based on the display screen data, the display content of the operation unit 140 is changed to the content (image 1410 corresponding to the first display form) drawn in the second half area of the VRAM 143, and the display content of the operation unit 30 is changed to the content (image 310 corresponding to the second display form) drawn in the first half area of the VRAM 143.

The image 1410 displays the alarm as the entire screen display as described above, and the image 310 displays the alarm as the icon 311, and enables operation for the image forming apparatus 1 as described above.

Though an operation unit (amount corresponding to a screen size from a start address of a VRAM) for an image forming apparatus main body side is generally displayed via a network on a terminal of an image forming system capable of remote operation for the remote operation, the image forming apparatus main body and the terminal of the image forming system capable of remote operation are different in display during the alarm according to this embodiment.

Moreover, the VRAM 143 present in the image forming apparatus main body 1*a* is extended so that the image specific to the image forming apparatus main body and the image specific to the terminal of the image forming system are generated during the alarm in these examples, and the image displayed in the image forming system is the image specific to the terminal of the image forming system.

As described above, the image forming apparatus on which the alarm event has occurred can change the display content to the full screen display or the blinking display, thereby strongly attracting attention of the user. Moreover, the alarm display is restricted to a partial display on another apparatus for the remote operation, thereby enabling a continuing operation.

An operable partial area may be left in the full screen alarm display, only a main display content needs to be the alarm display, and 50% or more or 70% or more of the display area is used for the alarm display, for example. Moreover, the partial alarm display may be carried out by means of an icon, a partial character display, or the like, and the other area can maintain display contents before the change.

Though a description is given of the screen display on the terminal (PC) 3 in the examples in FIGS. 6 and 7, the same display can be carried out on the terminal (tablet PC) 4.

Moreover, the control unit enables the remote operation of another apparatus based on an operator authentication, and when the alarm event occurs, the display content of the operation/display unit of the other apparatus can be changed according to the operator authentication. As a result, each operator can carry out the remote operation, and when an alarm event occurs, a display content to be changed on the other apparatus for the remote operation can be determined depending on an operator (such as a level of an operator). For example, for an operator who manages the image forming apparatus according to the level of an operator, a display may be carried out in the same display form on the other apparatus for the remote operation as that on the image forming apparatus, the display content may not be changed according to the operator, and an alarm may be displayed only for an authenticated person who can reset the alarm.

Figure 8:
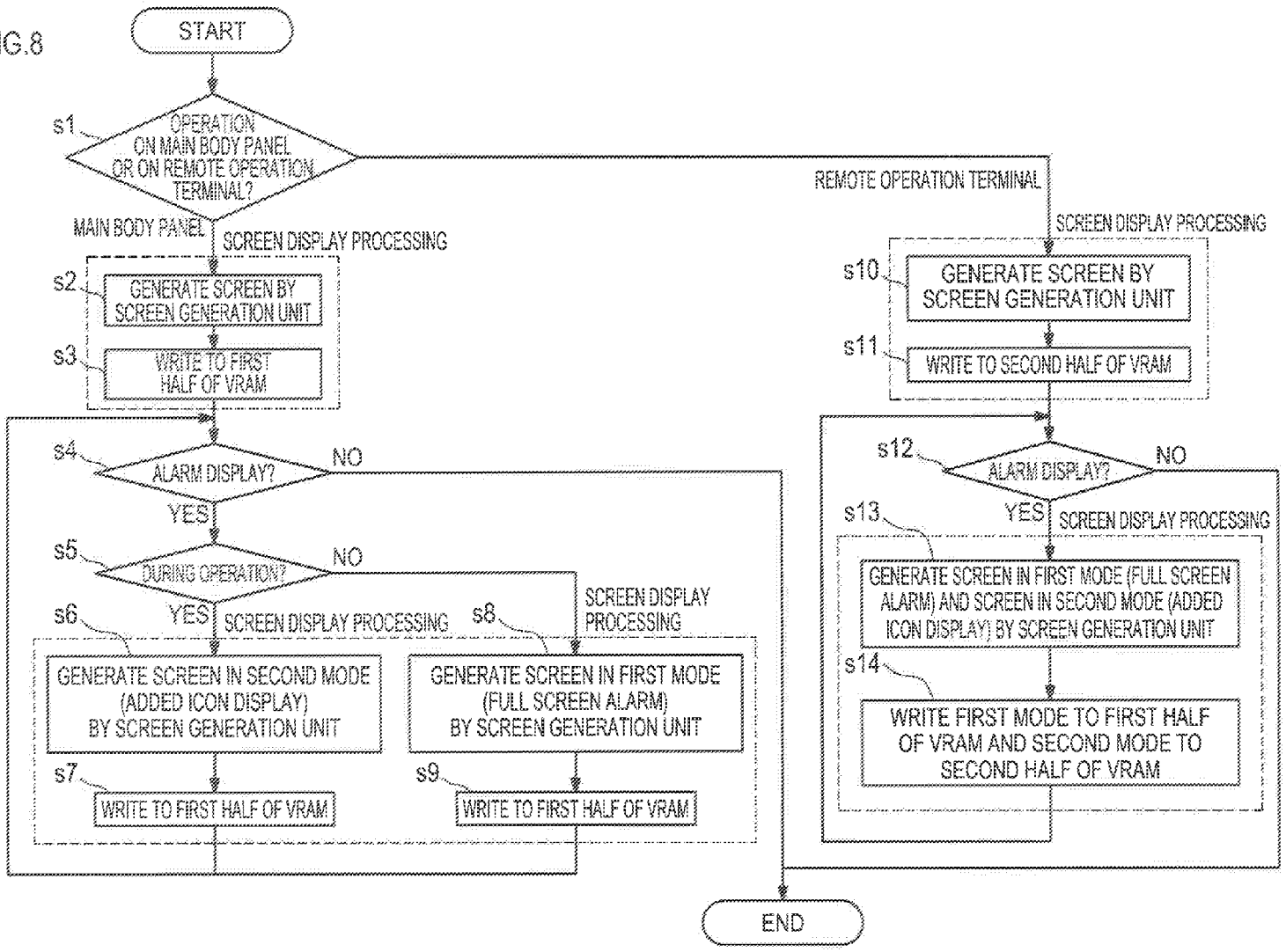
FIG. 8 is a flowchart showing a screen display sequence in the operation unit according to the embodiment of the present invention.
Figure 9:
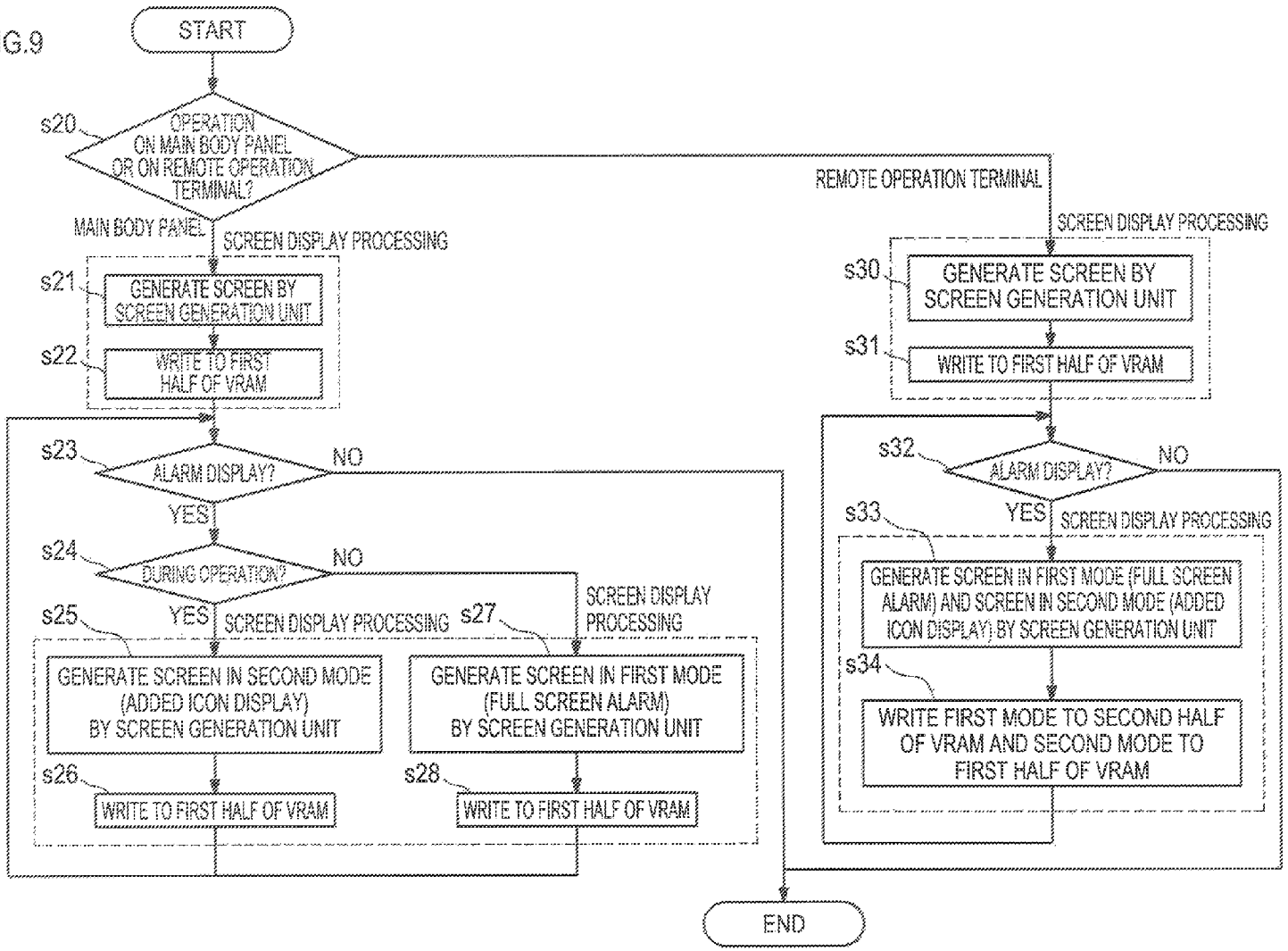
FIG. 9 is a flowchart showing another example of the screen display sequence in the operation unit according to the embodiment of the present invention.

A description will now be given of control sequences in the examples of the screen display referring to flowcharts in FIGS. 8 and 9. These sequences are carried out by the control CPU 110.

First, a description will be given of a control sequence in the screen display example in FIG. 6 referring to FIG. 8.

As the image forming system starts an operation, it is determined whether an operation is the main body panel operation or the remote operation terminal operation (Step s1). The main body panel operation refers to an operation by using the operation unit 140 of the image forming apparatus 1 (the same applies hereinafter).

If the operation is the main body panel operation (main body panel in Step s1), a screen is generated by the screen generation unit (corresponding to the display image generation unit) (step s2), and is written to the first half of the VRAM (Step s3). Then, it is determined whether the display is an alarm display or not (Step s4). If an alarm event has occurred, the display is an alarm display.

If the display is not an alarm display (NO in Step s4), the processing is finished, and if the display is the alarm display (YES in Step s4), whether the operation is being carried out or not is determined (Step s5). Whether the operation is being carried out or not can be determined by determining whether the operator has carried out a certain operation, and the screen is in a transitioned state or in an input wait state or not. If the operation is being carried out (YES in Step s5), the screen generation unit generates a screen in the second display mode (added icon) (corresponding to the second display form) (Step s6), and the screen is written to the first half of the VRAM (Step s7), and the processing returns to Step s4. If the operation is not being carried out (NO in Step s5), the screen generation unit generates a screen in the first display mode (full screen display) (corresponding to the first display form) (Step s5), and the screen is written to the first half of the VRAM (Step s9), and the processing returns to Step s4.

As a result, if an alarm event occurs during an operation of the panel of the image forming apparatus, and if the operation is not being carried out, the display is carried out in the first display form including a full screen alarm display, and if the operation is being carried out, the display is carried out in the second display form including the partial alarm display.

As described above, if the image forming apparatus the display content of which is to be changed is in the operation state, the display content of the image forming apparatus is changed to the second display form as in other apparatuses for the remote operation, thereby maintaining operability. As the operation state of the image forming apparatus, such a state that some operation has been carried out on an initial screen and an operation input is waited, and such a state that operation is actually being carried out can be mentioned.

On the other hand, if the operation is the remote operation terminal operation (remote operation terminal in Step s1), a screen is generated by the screen generation unit (step s10), and is written to the second half of the VRAM (Step s11). Then, it is determined whether the display is an alarm display or not (Step s12). If an alarm event has occurred, the display is an alarm display.

If the display is not an alarm display (NO in Step s12), the processing is finished, and if the display is an alarm display (YES in Step s12), the screen generation unit generates the screens in the first display mode (full screen alarm) (corresponding to the first display form) and in the second display mode (added icon) (corresponding to the second display form) (Step s13), the first display mode is written to the first half of the VRAM and the second display mode is written to the second half of the VRAM (Step s14), and the processing returns to Step s12.

As a result, if an alarm event occurs during the remote operation terminal operation, a display in the first display form having the full screen alarm display can be displayed on the image forming apparatus, a display in the second display form having the partial alarm display can be displayed on the terminal, and the remote operation can be continued on the terminal.

A description will now be given of a control sequence in the screen display example in FIG. 7 referring to FIG. 9.

As the image forming system starts an operation, it is determined whether an operation is the main body panel operation or the remote operation terminal operation (Step s20).

If the operation is the main body panel operation (main body panel in Step s20), a screen is generated by the screen generation unit (step s21), and is written to the first half of the VRAM (Step s22). Then, it is determined whether the display is an alarm display or not (Step s23). If an alarm event has occurred, the display is an alarm display.

If the display is not an alarm display (NO in Step s23), the processing is finished, and if the display is an alarm display (YES in Step s23), whether the operation is being carried out or not is determined (Step s24). Whether the operation is being carried out or not can be determined by determining whether the operator has carried out a certain operation, and the screen is in a transitioned state or in an input wait state or not. If the operation is being carried out (YES in Step s24), the screen generation unit generates a screen in the second display mode (added icon) (corresponding to the second display form) (Step s25), and the screen is written to the first half of the VRAM (Step s26), and the processing returns to Step s23. If the operation is not being carried out (NO in Step s24), the screen generation unit generates a screen in the first display mode (full screen display) (corresponding to the first display form) (Step s27), and the screen is written to the first half of the VRAM (Step s28), and the processing returns to Step s23.

As a result, if an alarm event occurs during an operation of the panel of the image forming apparatus, and if the operation is not being carried out, the display is carried out in the first display form including the full screen alarm display, and if the operation is being carried out, the display is carried out in the second display form including the partial alarm display.

As described above, if the image forming apparatus the display content of which is to be changed is in the operation state, the display content of the image forming apparatus is changed to the second display form as in other apparatuses for the remote operation, thereby maintaining operability.

On the other hand, if the operation is the remote operation terminal operation (remote operation terminal in Step s20), a screen is generated by the screen generation unit (step s30), and is written to the first half of the VRAM (Step s31). Then, it is determined whether the display is an alarm display or not (Step s32). If an alarm event has occurred, the display is an alarm display. If the display is not an alarm display (NO in Step s32), the processing is finished, and if the display is an alarm display (YES in Step s32), the screen generation unit generates the screens in the first display mode (full screen alarm) (corresponding to the first display form) and in the second display mode (added icon) (corresponding to the second display form) (Step s33), the first display mode is written to the second half of the VRAM and the second display mode is written to the first half of the VRAM (Step s34), and the processing is finished.

As a result, if an alarm event occurs during the remote operation terminal operation, a display in the first display form having the full screen alarm display can be displayed on the image forming apparatus, a display in the second display form having the partial alarm display can be displayed on the terminal, and the remote operation can be continued on the terminal.

Figure 10:
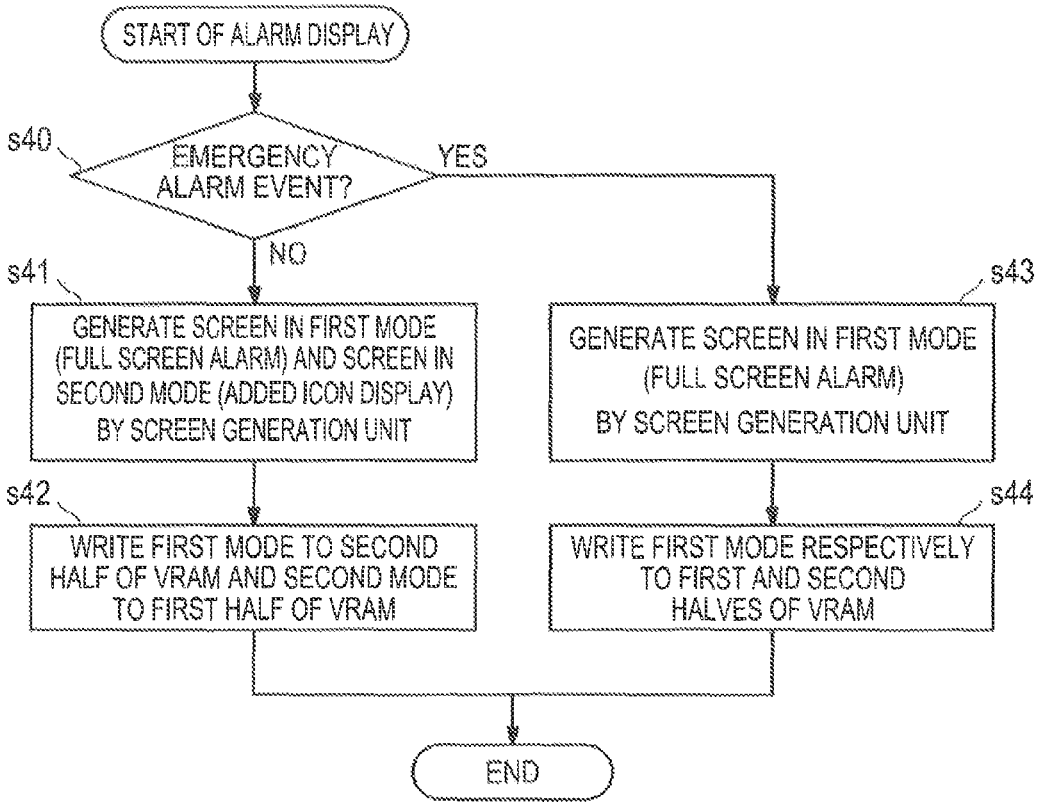
FIG. 10 is a flowchart showing a screen display sequence when an emergency alarm event occurs according to the embodiment of the present invention.

A description is now given of a sequence of changing a display content on an apparatus for the remote control when the emergency alarm event such as a failure of the image forming apparatus occurs for the alarm display referring to a flowchart in FIG. 10. The emergency alarm event includes an event which makes the remote operation itself difficult due to a failure.

When the alarm display starts, it is determined whether the alarm event is an emergency alarm event or not (Step s40). If the alarm event is not an emergency alarm event, the screen generation unit generates the screens in the first display mode (full screen alarm) (corresponding to the first display form) and the second display mode (added icon) (second display form) (Step s41), the screen corresponding to the first display mode is written to the second half of the VRAM, the screen corresponding to the second display mode is written to the first half of the VRAM (Step s42), and the sequential processing is finished as the sequences in FIGS. 8 and 9. The sequence follows the sequence in FIG. 9.

On the other hand, if the alarm event is an emergency alarm event (YES in Step s40), the image forming unit generates a screen in the first display mode (full screen alarm) (corresponding to the first display form) (Step s43), the first display mode is written to the first and second halves of the VRAM (Step s44), and the processing is finished. As a result, the display high in attention attraction can be carried out on the apparatus for the remote control for the emergency alarm display.

As described above, if the alarm event is an emergency alarm event, the display content of the other apparatus for the remote control is changed to the first display form as in the image forming apparatus to increase the degree of attracting attention, thereby prompting a quick response to the alarm event.

Though a description is given of such a case that the terminal remotely controls the image forming apparatus, the same description can be applied to such a case that another image forming apparatus remotely controls the image forming apparatus 1.

As described above, the embodiments can provides such an effect as to generate different situations such as one situation where the large scale alarm prompts a smooth response to the alarm, and another situation where a job or the like can be remotely controlled without seeing an unnecessary large-scale alarm display, and the alarm unnecessary to oneself does not need to be recognized.

Though the present invention is described based on the embodiment, the present invention may be properly modified as long as the modification does not depart from the scope of the present invention.

CROSS-REFERENCE TO RELATED APPLICATION

This application is based on Japanese Patent Application No. 2013-006706 filed with Japan Patent Office on Jan. 17, 2013, the entire content of which is hereby incorporated by reference.

What is claimed is:

1. An image forming system wherein an image forming apparatus and another apparatus respectively including operation/display units are connected with each other via a network, and a remote operation of the image forming apparatus is enabled via the operation/display unit of the other apparatus, comprising:

a control unit for managing a state of the image forming apparatus, wherein when an alarm event occurs in the image forming apparatus during the remote operation, the control unit generates a first alarm display screen and displays the first alarm display screen on the operation/display unit of the image forming apparatus, and generates a second alarm display screen which is different from the first alarm display screen, and the other apparatus acquires the second alarm display screen from the image forming apparatus and displays the second alarm display screen on the operation/display unit of the other apparatus.

2. The image forming system according to claim 1, wherein the first alarm display screen is higher in attracting attention than that of the second alarm display screen.

3. The image forming system according to claim 1, wherein the first alarm display screen includes an entire alarm display or a blinking display, and the second alarm display screen includes a partial alarm display.

4. The image forming system according to claim 3, wherein and the second alarm display screen has an icon of an alarm display as the partial alarm display.

5. The image forming system according to claim 1, wherein when the alarm event occurs in the image forming apparatus, if the image forming apparatus is in an operation condition, the control unit displays the second alarm display screen on the operation/display unit of the image forming apparatus.

6. The image forming system according to claim 1, wherein if the alarm event is determined to correspond to an emergency alarm event, the other apparatus acquires the first alarm display screen from the image forming apparatus and displays the first alarm display screen on the operation/display unit of the other apparatus.

7. The image forming system according to claim 1, wherein the control unit enables a remote operation by the other apparatus based on an operator authentication, and when the alarm event occurs in the image forming apparatus, changes the display content of the operation/display unit of the other apparatus according to the operator authentication.

8. The image forming system according to claim 1, wherein the other apparatus is an external apparatus or another image forming apparatus.

9. An image forming apparatus connected via a network to another apparatus, and remotely operable via an operation/display unit of the other apparatus, comprising:

an operation/display unit capable of carrying out operation and display of the image forming apparatus; and a control unit for managing a state of the image forming apparatus, wherein when an alarm event occurs in the image forming apparatus during the remote operation, the control unit generates a first alarm display screen and displays the first alarm display screen on the operation/display unit of the image forming apparatus, generates a second alarm display screen which is different from the first alarm display screen, and provides the second alarm display screen to the other apparatus.

10. The image forming system according to claim 9, wherein the first alarm display screen is higher in attracting attention than that of the second alarm display screen.

11. The image forming apparatus according to claim 9, wherein the first alarm display screen includes an entire alarm display or a blinking display, and the second alarm display screen includes a partial alarm display.

12. The image forming apparatus according to claim 9, wherein when the alarm event occurs in the image forming apparatus, if the operation/display unit of the image forming apparatus is in an operation condition, the control unit displays the second alarm display screen on the operation/display unit of the image forming apparatus.

13. The image forming apparatus according to claim 9, wherein the operation/display unit of the image forming apparatus is provided above an apparatus top surface, and a display screen is provided to face to a front side.

14. A non-transitory computer-readable recording medium encoded with a control program for an image forming apparatus, the image forming apparatus and another apparatus respectively including operation/display units, and connected with each other via a network, the other apparatus capable of remotely operating the image forming apparatus, the control program for the image forming apparatus causing a computer to execute the steps of:

determining whether an alarm event has occurred in the image forming apparatus based on a state of the image forming apparatus during the remote operation; and generating a first alarm display screen and displaying the first alarm display screen on the operation/display unit of the image forming apparatus and generating a second alarm display screen which is different from the first alarm display screen, and providing the second alarm display screen to the other apparatus, when it is determined that the alarm event occurs.

15. The non-transitory computer-readable recording medium encoded with the control program for the image forming apparatus according to claim 14, wherein the first alarm display screen is higher in attracting attention than that of the second alarm display screen.

16. The non-transitory computer-readable recording medium encoded with the control program for the image forming apparatus according to claim 14, wherein the first alarm display screen includes an entire alarm display or a blinking display, and the second alarm display screen includes a partial alarm display.

17. The non-transitory computer-readable recording medium encoded with the control program for the image forming apparatus according to claim 14, wherein when the alarm event occurs in the image forming apparatus, if the operation/display unit of the image forming apparatus is in an operation condition, the control program for the image forming apparatus causes the computer to execute the step of displaying the second alarm display screen on the operation/display unit of the image forming apparatus.

* * * * *